US005240058A

United States Patent [19]

Ward

[11] Patent Number: 5,240,058

[45] Date of Patent: Aug. 31, 1993

[54] SMOKE CONTAINMENT CURTAIN SYSTEM AND METHOD OF INSTALLATION

[75] Inventor: Thomas T. Ward, Clarksville, Va.

[73] Assignee: Construction Consultants & Contractors, Inc., Clarksville, Va.

[21] Appl. No.: 837,343

[22] Filed: Feb. 14, 1992

[51] Int. Cl.[5] ..... A47H 1/00

[52] U.S. Cl. ..... 160/123; 160/369; 52/39; 52/63; 52/484

[58] Field of Search ..... 160/123, 126, 330, 368.1, 160/354, 327, 328, 352, 405, 369; 52/28, 22, 273, 484, 27, 39, 63

[56] References Cited

U.S. PATENT DOCUMENTS

| | | | |
|---|---|---|---|
| 2,527,031 | 10/1950 | Rambusch | 52/484 X |
| 3,455,366 | 7/1969 | Bogumil | 160/368.1 |
| 3,685,238 | 8/1972 | Fisher et al. | 52/484 X |
| 3,715,969 | 2/1973 | Burgess | 160/330 X |
| 4,041,668 | 8/1977 | Jahn et al. | 52/484 X |
| 4,081,931 | 4/1973 | Miyoshi | 52/39 |
| 4,250,668 | 2/1981 | Harrison | 52/39 |
| 5,090,163 | 2/1992 | New | 52/484 X |

*Primary Examiner*—David M. Purol
*Attorney, Agent, or Firm*—Olive & Olive

[57] ABSTRACT

The invention provides a system to divide a ceiling of a building into smoke containment cells utilizing suspended and interconnected curtains. Resilient jawed clips are utilized to simply and firmly attach the curtains, mounted on rigid supporting bars, to roof deck supporting joists or girders. Methods are employed within the system to seal around intersecting ducts or pipes, to abutting curtains and to the underside of the roofing deck.

16 Claims, 5 Drawing Sheets

SMOKE CONTAINMENT CURTAIN SYSTEM AND METHOD OF INSTALLATION

FIELD OF THE INVENTION

This invention relates to the field of fire safety apparatus and more particularly to the field of smoke barriers.

BACKGROUND OF THE INVENTION

In recent years it has been recognized by governmental agencies which are responsible for fire safety that more injuries and deaths occur in a building fire situation due to the inhalation of smoke than by direct burns. Along with this determination of the severe danger posed by smoke, legislatures and building code authorities in many states have enacted new regulations which require dealing with smoke as a prime building design requirement.

One code which deals with this situation and spells out the parameters of smoke control is the North Carolina State Building Code, 1991 Edition, particularly Volume V, relating to Fire Prevention. This code section mandates, under Table 3607, that buildings having floor areas in excess of 10,000 square feet in a single expanse must have their ceilings divided into cell-like areas of from 2,000 to 10,000 square feet to contain and remove smoke from an accidental fire.

The North Carolina Building Code specification requires a "curtain board" to descend from the ceiling for a distance of either four (4) or six (6) feet depending on the height of the ceiling (ranging up to 40 feet) and a fire hazard classification for the building. This "curtain board" joins other "curtain boards" to form a gridwork of rectangular cells on the ceiling; in the approximate center of each cell is an automatically operative ventilator.

In case of a fire, smoke will rise from the source and come into contact with the ceiling. Under prior ceiling conditions, i.e. no "curtain boards", this smoke would spread over the entire ceiling. Under the new regulations, the "curtain boards" in the event of a fire will contain the smoke created in the one or few sections of ceiling where it arose and the cell ventilator, actuated by a smoke detector, will draw that smoke out of the building. Once the smoke is gone, the danger to both occupants and fire fighters is reduced substantially.

Prior to the present invention, the accepted curtain board apparatus and method of installation was relatively expensive, was time consuming and required considerable skill. The prior art material utilized for the "curtain board" was a heavy weight fiber glass fabric which had been resin impregnated to prevent smoke passage. No specification is written for the material characteristics or performance of the "curtain board" in the North Carolina Code. The referred to fabric was used in long lengths and in a width of either four (4) or six (6) feet as per the regulations. This fabric was clamped along an upper longitudinal edge between a piece of angle iron and a piece of flat iron by means of screws and nuts. The lower longitudinal edge of the fabric was sewn with a continuous loop, or pocket, into which was placed an iron rod to keep the curtain hanging vertically down. The angle iron which was clamped to the upper edge of the fabric was in a last step, welded to a joist or girder close to the ceiling level to create one wall of the ceiling dividing cell.

As can be readily seen, the operations employed to make an existing technology curtain board include drilling matching holes in an angle iron and a flat iron piece, piercing a heavy fabric, bolting an assembled angle iron, fabric and flat iron installing the rod and welding the angle iron to a ceiling iron component. In addition, equipment is needed and skill is required for the operations of drilling the holes in the angle iron and flat iron and welding the angle iron to the ceiling framework.

A particular drawback in addition to the labor and skill needed to install the referred to prior art apparatus is due to the operation of welding. If such a system is intended to be installed in an existing building, the welding which occurs at ceiling level will result in some falling sparks. If materials normally housed in the building are not moved or properly covered, the sparks cause a serious fire hazard.

Therefore, it is an objective of the present invention to provide a smoke curtain apparatus and installation method which conforms to building code requirements for smoke containment curtains.

It is a further objective of the invention to provide a curtain apparatus and installation method which is capable of efficient and inexpensive installation.

It is an additional objective of the invention to provide a curtain apparatus and installation method which may be effectuated in an existing, in-use building without danger to materials which may be stored in that building.

These and other objectives will be apparent to those skilled in the art as the details of the disclosure below are understood.

SUMMARY

The smoke containment curtain system and method of the invention comprises a combination of standard building components in unique application together with specially designed components. A rectangular shaped curtain fabric of fiber glass which has been coated with a resin to reduce passage of smoke and which has been sewn with a longitudinal pocket along both parallel long edges is assembled to a pair of upper and lower tubular metallic members and connective fixtures. At designed intervals, cross members are mounted by means of "T" connectors between upper and lower members to create a rectangular frame with stiffness. At further intervals, perpendicular curtains contained in similar frames intersect the primary curtain and are connected with five-way junction fixtures. Where curtains intersect each other and where other building structures, such as ducts or pipes, intersect a curtain, the resulting seam is sealed with a fire rated adhesive coated tape of the same material as the curtain.

On installation, a slit is cut through the fabric slightly below the upper longitudinal tubular member. A double jaw, resilient, barbed metallic clip has one jaw forced onto a lateral flange of a ceiling supporting joist or girder and the tubular member forced into the opposite jaw of the clip at the location of the cut slit. This apparatus and method of assembly avoids the need to drill and screw the curtain board together and to weld the assembly to the ceiling support members as has been previously done.

DESCRIPTION OF PREFERRED EMBODIMENT

As described briefly above, the curtain containment system provided by the invention relates to smoke containment curtains which are suspended from the underside of a roofing deck of a building and which end at a level far above the floor. The primary purpose of such a system is to confine smoke generated by a fire within a building to a small ceiling area and to enable rapid extraction of that smoke by means of automatically actuated ventilators. The ventilators may be activated by smoke detectors or by other appropriate means. Each section, or cell, of ceiling as defined by a grouping of connected smoke containment curtains has a ventilator and actuator in its central area.

Figure 1:
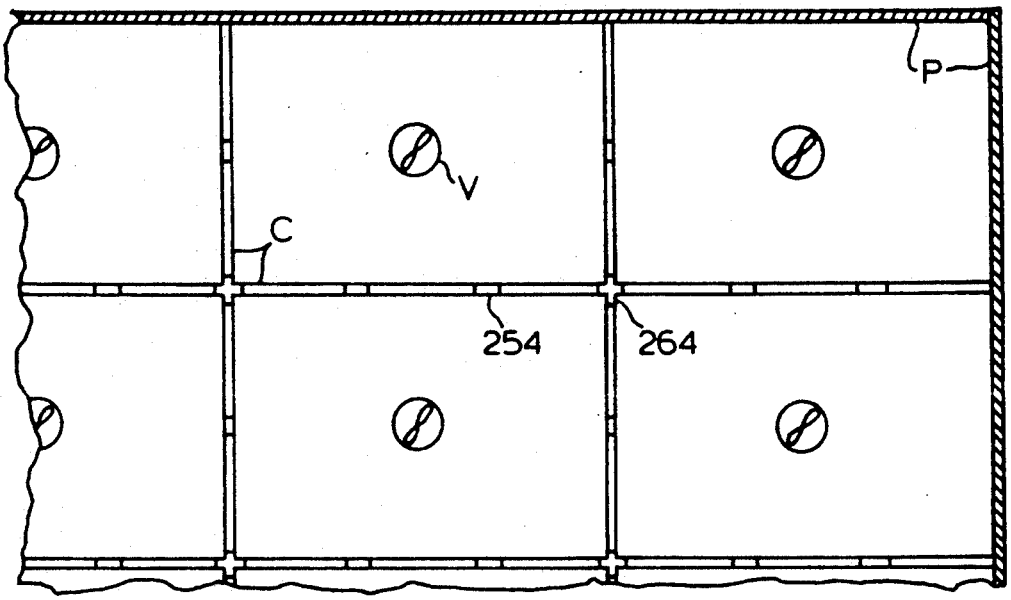
FIG. 1 is a plan view of a portion of roofing deck of a typical building as seen from below with the roof supporting structural members eliminated for simplicity and showing a curtain system according to the invention installed thereon to divide the ceiling into smoke containment cells and having a ventilator in each cell to remove smoke.

Referring now to FIG. 1, a portion of the ceiling of a warehouse building is seen in an upwardly directed plan view. Perimeter wall P defines the boundary of the building or portion of the building. According to the requirements of the building code, curtains C, capable of confining smoke, are installed utilizing later explained components of the invention so as to divide the ceiling area into sections, or cells, of no more than a specified maximum size. In approximately the center of each cell is a ventilator V, installed through the roofing deck and having an associated actuator so as to be capable of removing the smoke from that cell in case of fire.

Figure 2:
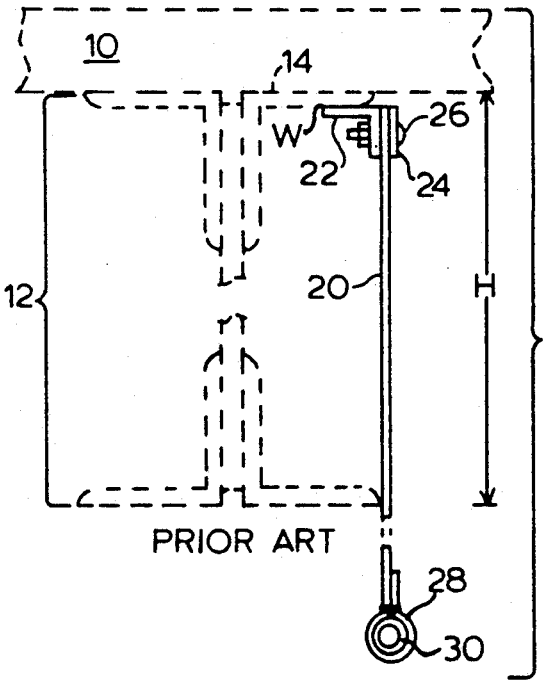
FIG. 2 is an end elevation view of roofing deck with a supporting bar joist and having a curtain board apparatus of the prior art attached thereto.
Figure 3:
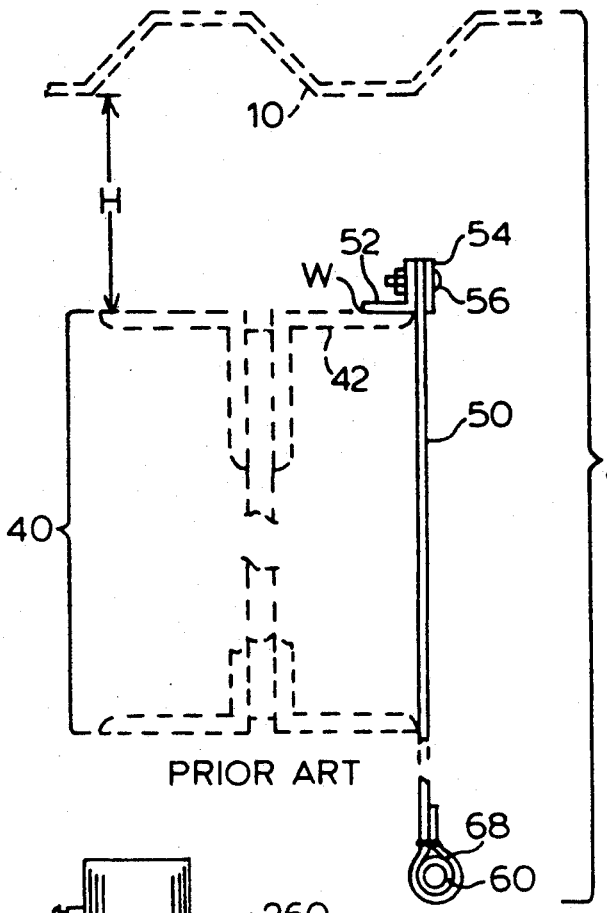
FIG. 3 is a side elevation view of a roofing deck and a joist girder spaced therebelow at a distance sufficient to accommodate a bar joist and having a curtain board apparatus of the prior art suspended thereform.

A depiction of the prior art smoke confinement curtain system is shown in FIGS. 2 and 3. FIG. 2 shows a roofing deck 10 supported on bar joist 12, both in dashed lines. In actual construction, bar joist 12 is supported by a series of joist girders 40 as seen in FIG. 3 in dashed lines. The space H between joist girder 40 and roofing deck 10 is the same as space H of FIG. 2 from the bottom of bar joist 12 to roofing deck 10. Thus bar joist 12 of FIG. 2 is resting on and perpendicular to joist girder 40 of FIG. 3.

FIG. 2 illustrates roofing deck 10 supported by bar joist 12 which has upper flange 14 protruding outwardly on each side of the joist centerline in a direction generally parallel to roof deck 10. Smoke confinement curtain 20 is clamped at its upper edge between angle iron 22 and flat iron 24 by means of a series of screws and nuts 26 placed through holes previously drilled through the three parts. Curtain 20, made of a relatively heavy resin-impregnated fiber glass fabric, hangs down in a basically vertical direction. A longitudinal hem, or pocket 28, is sewn along the lower edge of curtain fabric 20 and a steel rod 30 is inserted into pocket 28 to keep curtain 20 hanging straight. This assembly of angle iron 22, flat iron 24, screws and nuts 26, curtain 20 and rod 30 is suspended below flange 14 of bar joist 12 by the process of welding at the interface indicated by W at appropriate intervals along bar joist 12.

FIG. 3 further illustrates the prior art from a direction perpendicular to that of FIG. 2. Space H above girder 40 is taken by joist 12 of FIG. 2. The assembly of curtain 50 and its associated hardware is similar, but not identical to that of curtain 20 (FIG. 2). Since girder 40 is lower than joist 12 and thus leaves a greater space below roof deck 10, it is preferred to suspend curtain 50 slightly higher relative to girder 40. For that reason, angle iron 52 is bolted to curtain 50 with its vertical flange facing upward. Also, angle iron 52 is attached by weld W above, rather than below flange 42.

Figure 4:
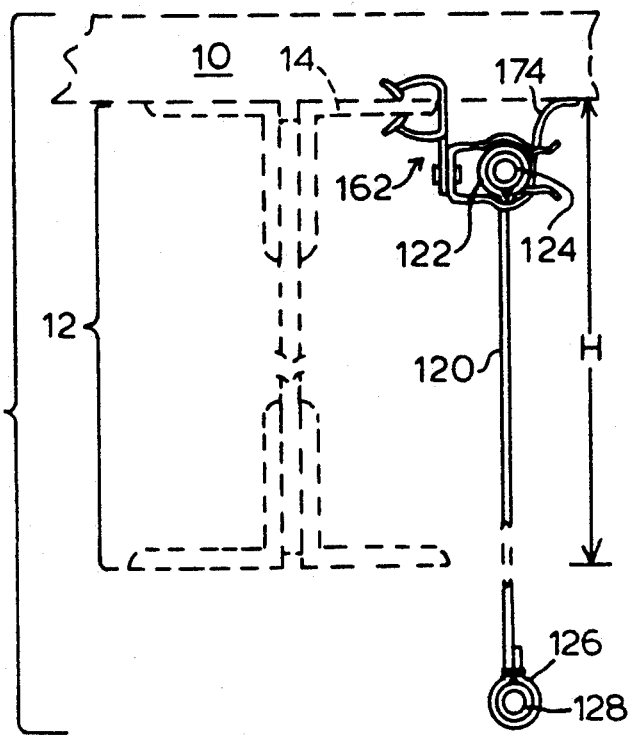
FIG. 4 is an end elevation view of a roofing deck with a supporting bar joist and having a smoke containment curtain of the present invention attached thereto.

FIG. 4 illustrates a similar view of a building roof support structure as was seen in FIG. 2. Bar joist 12, having flange 14, supports roofing deck 10, all in dashed lines. The curtain system of the invention is shown suspended from flange 14 so as to hang vertically downward. A double jaw spring clip 162 attaches to upper tubular bar 124 which holds curtain 120 which, in turn suspends lower bar 128.

Figure 6:
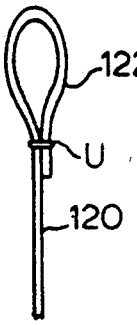
FIG. 6 is an end elevation view of the curtain of the invention illustrating the formation of the upper pocket which has been sewn longitudinally.

A detailed view of the upper sewn pocket 122 of curtain 120 is seen in FIG. 6. Curtain 120 has pocket 122 sewn into its upper edge by stiches U and a similar pocket sewn into its lower (not shown) longitudinal edge. Curtain 120 is made of a relatively light weight resin coated fiberglass fabric which is essentially impervious to smoke at normal low pressure. A coated fiber glass fabric which is effective in the embodiment of the invention is Sandel® fabric manufactured by Firesafe Products Incorporated, New York, N.Y. The Sandel® fabric specification describes the fabric as weighing 8.6 ounces per square yard maximum weight, as being non-ignitible and as having 0.0 CFM air permeability.

Figure 7:
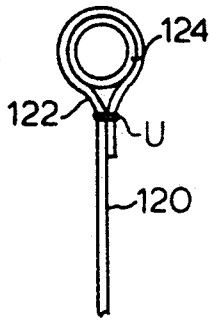
FIG. 7 is an end elevation view of the curtain of the invention having an upper bar placed into the sewn upper pocket.
Figure 10:
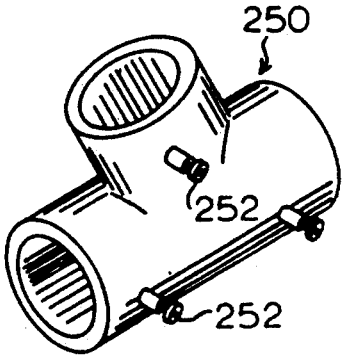
FIG. 10 is a perspective view of a "T" connector of the invention.
Figure 11:
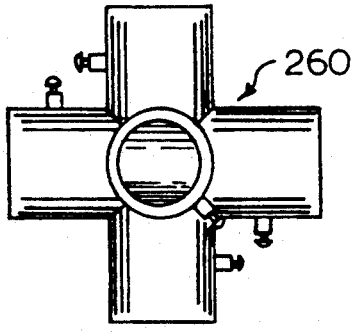
FIG. 11 is a plan view of a five-way connector of the invention.

After curtain 120 has been prepared for assembly by the sewing of pocket 122, a length of bar 124 is inserted longitudinally into pocket 122 of the upper edge, as seen in FIG. 7. A particularly functional, economical and sufficiently strong material to be used as bar 124 is ½-inch steel electrical conduit. Electrical conduit, serving as bar 124, is light weight, relatively stiff, and is commercially available from a variety of sources. The ends of bars 124 are joined to each other by means either of a "T" connector (shown in FIG. 10) or, if at an intersection of two curtains, by a five-way connector (shown in FIG. 11).

Figure 8:
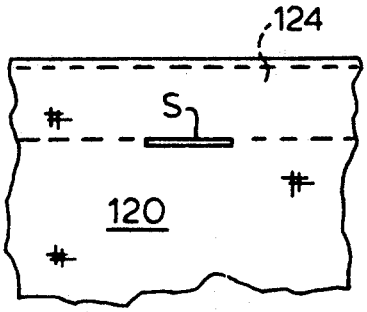
FIG. 8 is a side elevation view of the curtain of the invention with the upper bar, illustrated by dashed lines, in the upper pocket and having a slit formed through the fabric thereof beneath the upper bar.

The next step is to mount suspending clips to curtain 120 and upper bar 124 to enable attachment to roof 10 supporting steel joist 12. As shown in FIG. 8, a small slit S is made through curtain 120 at a position slightly below bar 124 and of a width sufficient to permit the passage of a jaw of clip 162, or similar fastening means.

Figure 9A:
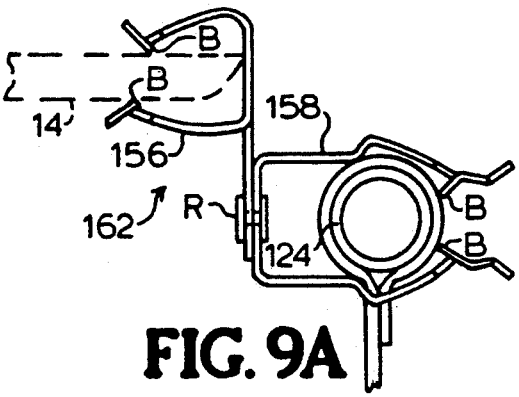
FIG. 9A is a side elevation view of a double jawed clip of the invention with one jaw attached to a flange of a bar joist (in dashed lines) and having a portion of tubular fabric support bar in the other jaw.

Looking now to FIG. 9A, a side elevation view of clip 162 is shown assembled to partially illustrated components flange 14 and bar 124. Clip 162 is a double jawed firmly resilient clip, with jaws 156, 158 facing in opposite directions and at different heights and having inwardly facing retaining barbs B on upper and lower portions thereof. A workable variation is to have both jaws face in the same direction. As desicribed above, bar 124 is snapped into jaw 158 of clip 162 after bar 124 is slid into pocket 122 of curtain 120, as seen in FIG. 7. Having clip 162, bar 124 and curtain 120 as an assembly, upper jaw 156 is forced onto flange 14 of the joist, generally by means of a hammer, for which purpose the offset of the two jaws 156, 158 is a preferred embodiment. The barbs B formed in each portion of each jaw 156, 158 are adapted to aggressively clamp bar 124 and flange 14 and resist removal therefrom. Clip 162 is of a type which is commercially available from B-Line Systems, Inc. of Highland, IL as model number BP-8-E-5-8.

The mounting of clip 162 and curtain 120 is seen more fully in FIG. 4. Having mounted clip 162, upper bar 124 and curtain 120 to flange 14, lower bar 128 is placed into lower pocket 126. As was discussed above, curtain 120 extends downward from roof deck 10 a distance of either 4 feet or 6 feet, according to the specification of the building code or architect's design.

Figure 5:
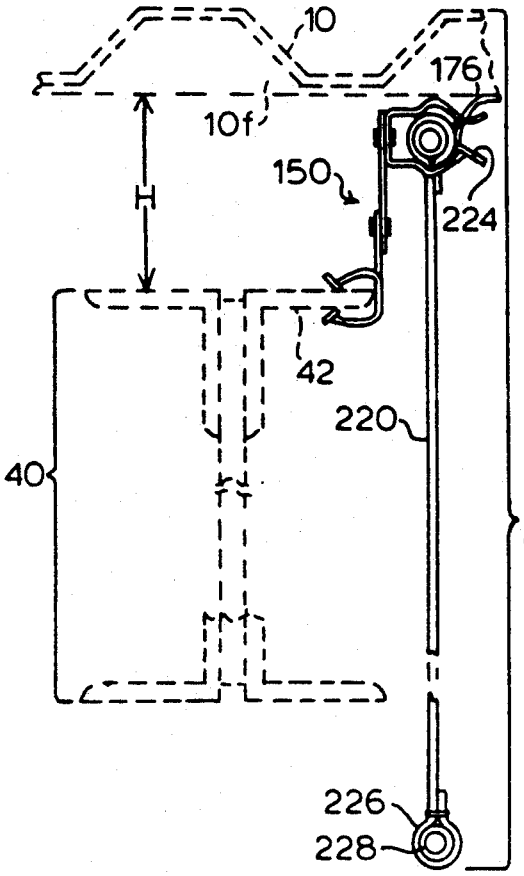
FIG. 5 is a side elevation view of a roofing deck and a joist girder spaced therebelow at a distance sufficient to accommodate a bar joist and having a smoke containment curtain of the invention attached thereto.
Figure 9B:
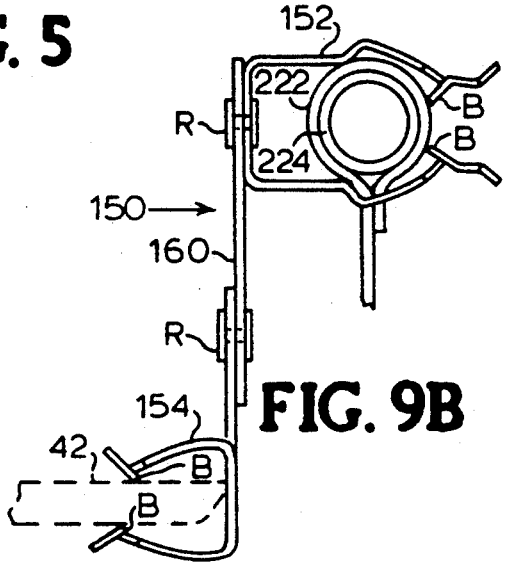
FIG. 9B is a side elevation view of an alternate double jawed clip of the invention with one jaw attached to a flange of a joist girder (in dashed lines), having an extender bar between the two jaws and holding a curtain supporting bar in the other jaw.

The alternate mounting configuration of the invention is depicted in FIG. 5, with details of the appropriate mounting clip being shown in FIG. 9B. FIG. 5 shows space H between girder 40, shown in dashed lines, and roof deck 10 which space is actually occupied at uniform intervals by bar joist 12. The downwardly open portions of trapezoidal corrugations of roofing deck 10 are filled with an insulative foamed material 10F. This foamed material 10F serves as a thermal insulation and additionally as a filler to present a substantially flat lower surface to which curtain 220 may be sealed. In this hanging situation, it is recognized that by mounting curtain 220 higher relative to girder 40, it is closer to roofing deck 10 and is also at the same height as the bar joist-suspended curtain 120 of FIG. 4. To accomplish this height equalazation, clip 150, FIG. 9B, is configured differently than clip 162. Jaws 152, 154 are similar to respective jaws 158, 156 of clip 162. However extender bar 160 is added so as to separate jaws 152, 154 sufficiently to raise upper bar 224, when clip 150 is fixedly attached to flange 42 of girder 40, and be at a distance substantially equal to that of bar 124 from roof deck 10. Extender bar 160 may be attached to jaws 152, 154 by means of rivets R or other acceptable attachment means. The length of bar 160 is adequate to position jaw 152 close to roofing deck 10, or, alternatively bar 160 could be configured with length adjustment means (not shown) to vary according to the situation encountered.

In order to complete the confinement of smoke with the cell created by the curtains of the invention, attachment to the ceiling or lower roof deck surface is desirable. FIG. 4 illustrates adhesive tape 174 and FIG. 5 illustrates adhesive tape 176 spanning from respective curtain 120, 220 to roofing deck 10. The tape 174, 176 utilized is preferred to be of the fiber glass fabric of which curtain 220 is made with a fire retardant pressure sensitive adhesive on one side.

Figure 12:
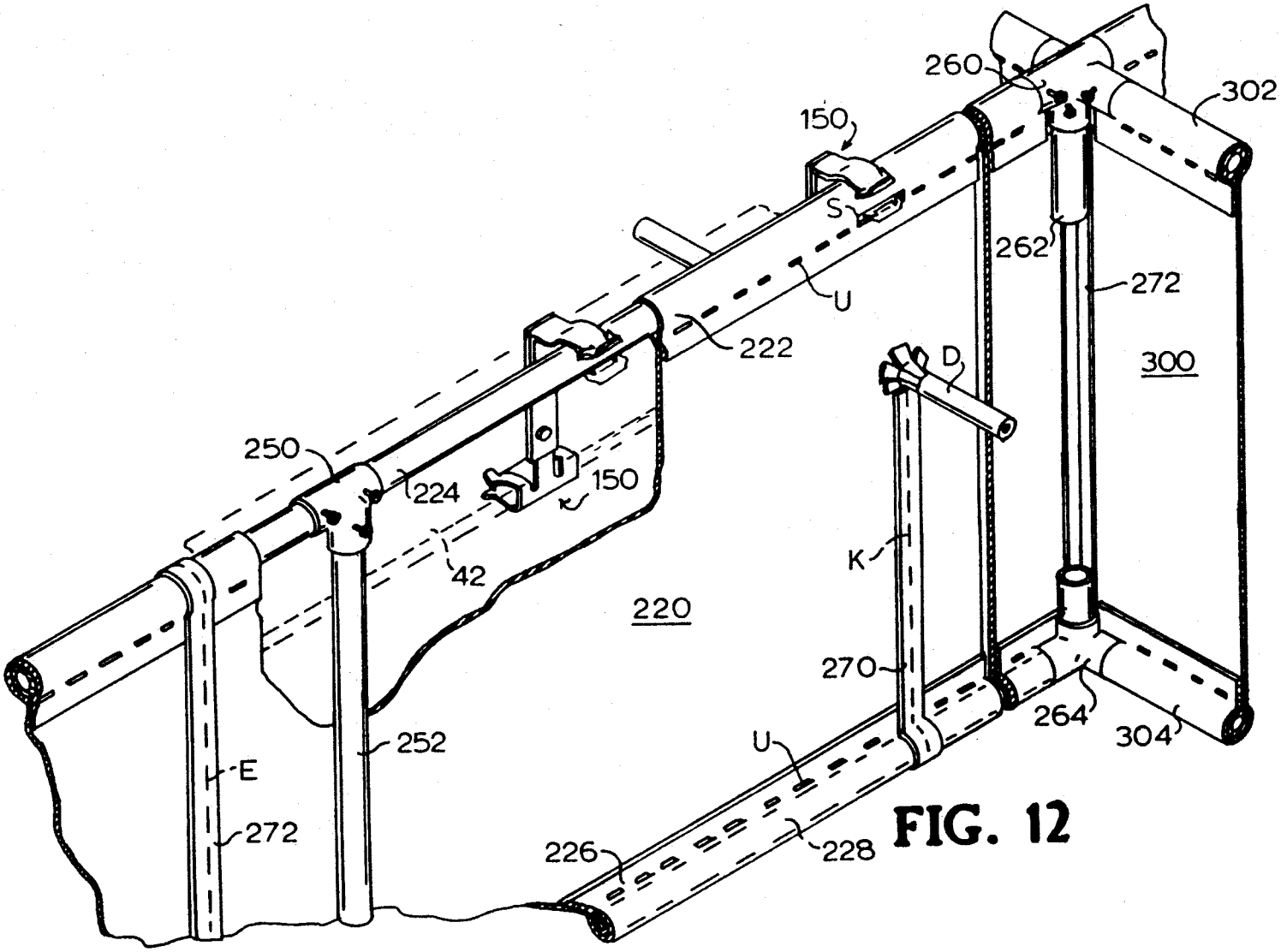
FIG. 12 is a perspective view of the smoke containment system of the invention and depicting a fabric having two longitudinal pockets sewn into opposite longitudinal edges, tubular bar members placed in the sewn pockets, cross members connected at intervals between tubular members with "T" connectors and five-way connectors and tape sealed seams at fabric junctions and at a cut for a crossing duct or pipe.

A perspective view of the overall curtain system is illustrated in FIG. 12. Upper and lower bars 224, 228 are normally supplied in working lengths, which in the case of electrical conduit, would be 10 feet. In order to connect multiple lengths of bars 224, 228 in a series, a coupling or connector is needed. Since it is recognized that cross bars are also useful to stiffen the curtain support system, "T" connectors 250 (FIG. 10) are a practical component to utilize. The "T" connector is specially adapted to permit the junction of three bars of the invention system and clamp the ends of the bars by means of clamping screws 252.

Returning to FIG. 12, smoke containment curtain 220 having upper bar 224 with "T" connector 250 and five-way special connector 260 placed in pocket 222 and clip 150 assembled thereto is next forced by means of a hammer onto flange 42. As curtain 220 fabric drapes down it comes into contact at certain positions with various pipes or ducts, indicated by D, which cross the location of curtain 220. A cut K is made into curtain 220 from the bottom vertically up to the level of duct D. At the level of duct D, a circumferential cut may optionally be made, depending primarily on the size of duct D. Curtain 220 is then allowed to drop to below duct D on either side and cut K is sealed with adhesive coated tape 270, including the opening around duct D. Tape 270 is the same adhesive coated fiberglass tape employed and described above.

When all ducts D across which curtain 220 passes have been accommodated by the method described, lower bar 228 is slid into lower pocket 226 in position parallel to and beneath upper bar 224. Upper pocket 222 and lower pocket 228 are formed by respective lines of stitches U. A "T" connector 254 (not shown) is fastened between sections of lower bar 228 to create an effectively continuous bar. As depicted in FIG. 12, a similar "T" connector 250 on upper bar 224 has its center perpendicular leg facing downward; the "T" 254 (not shown) on lower bar 228 has its center perpendicular leg facing upward. A vertical cross bar 252 is placed into upper "T" connector 250 and into lower "T" connector 254 and the respective clamping screws tightened so as to link upper and lower bars 224, 228 into a rigid frame. With bar lengths of 10 feet and "T" connectors at each joint, a series of rectangular frames are created to support curtain 220.

The fabric of which curtain 220 is made is supplied in long lengths on rolls. At the end E of one roll, a splice is made to join to the beginning of another roll with the same type tape 272 as that used to seal cut K beneath duct D. In that manner a new roll is continued when a previous roll terminates.

Referring back to FIG. 1, curtains C must intersect at intervals to form containment cells dependent on building specifications. At the intersection, the connection of upper and lower bars 228, 224 (FIG. 12) is accomplished by utilizing a five-way connector 264 (see FIG. 11). As seen in perspective (FIG. 12), curtain 300 intersects curtain 220 with upper bar 302 engaging five-way connector 260 and lower bar 304 engaging five-way connector 264. Curtain 300 is cut to a length to contact curtain 220 and seam sealing tape 272 is used to seal the two curtains together. Cross bar 262 spans between upper and lower five-way connectors 260, 264.

The completion of the smoke containment and removal system is accomplished by means of ventilators V which are installed through roof deck 10 and are electrically connected to smoke detectors or other automatic activation means. All materials used in the preferred embodiment are impervious to smoke and are not damaged by heat up to approxiamtely 1100° F.

It will be understood by those skilled in the art that the principal concepts of the invention involve a system having a hanging member capable of separating a ceiling area into cells and being suspended reliably from a roof supporting structural member. The primary form of the preferred embodiment is a system installed below a steel girder and joist supported roof deck. Other possible structural configurations which adapt readily to the invention are a "Z" purlin roof support, a wood beam structure and an internally hung panel ceiling.

Figure 13:
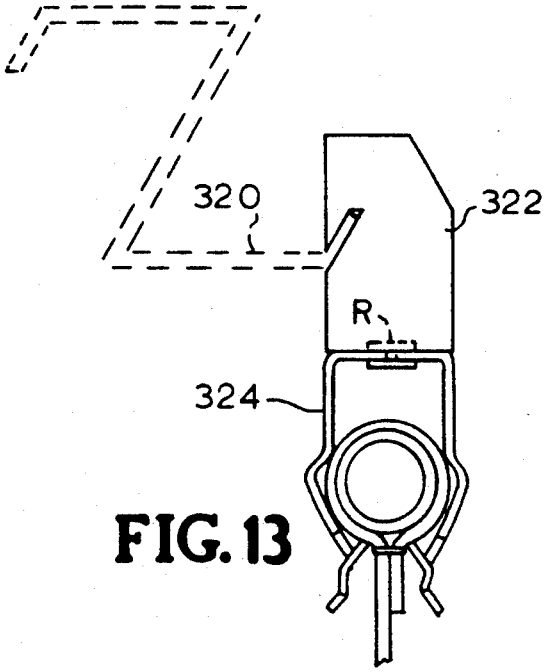
FIG. 13 is an end elevation view of an alternate clip of the invention having an upper hook attached to a "Z" purlin and a lower jaw holding a curtain supporting bar.

The "Z" purlin is a modification of a joist having a "Z" cross section and terminating at each edge in an upwardly or downwardly bent lip. The "Z" purlin 320, illustrated in FIG. 13 in dashed lines, is supported by the joist girder (not shown) in similar manner to other types of joist. A hanging hook 322 having a resilient jaw 324 attached thereto as supplied by B-Line Systems, Inc. as Item #BP-8-F13, performs this operation. The further details of installing the smoke containment curtain are similar to the description above. A minor variation is that due to the fact that jaw 324 faces downward, it is not necessary to cut a slit through the curtain fabric at its point of attachment.

Figure 14:
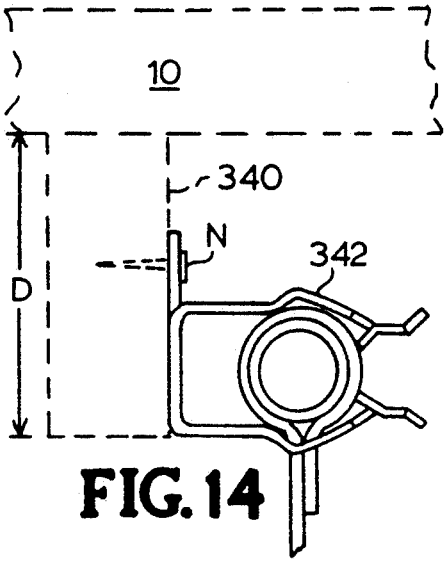
FIG. 14 is an end elevation view of an alternate clip of the invention being attached to a wood joist and having a jaw holding a curtain supporting bar.
Figure 15:
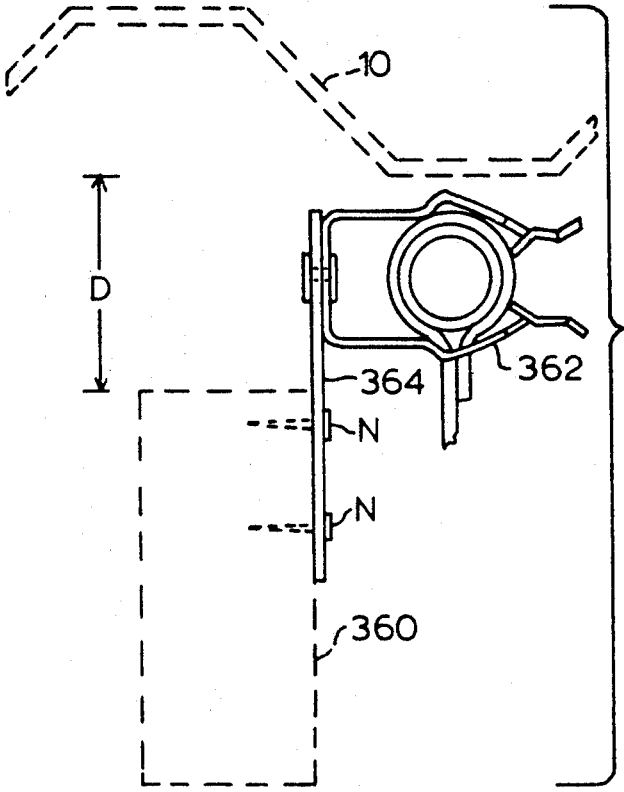
FIG. 15 is an end elevation view of an alternate clip of the invention being attached to and positioned above a wood girder and having a jaw holding a curtain supporting bar.

FIGS. 14 and 15 demonstrate the adaptation appropriate in the case of wood beams (340 and 360) supporting roofing deck 10, shown in dashed lines. As shown in FIG. 14, a resilient single jaw clip 342, B-Line Systems, Inc. Item #BP-8-D3, is mounted by means of a screw or nail N to beam 340 and the curtain of the invention hung there below. The height D of beam 340 is the same as height D in FIG. 15 between beam 360 and roofing deck 10 as earlier described. To accommodate this space D, clip 362 is modified by the addition of extender bar 364 so that the curtain closely approaches roofing deck 10.

Figure 16:
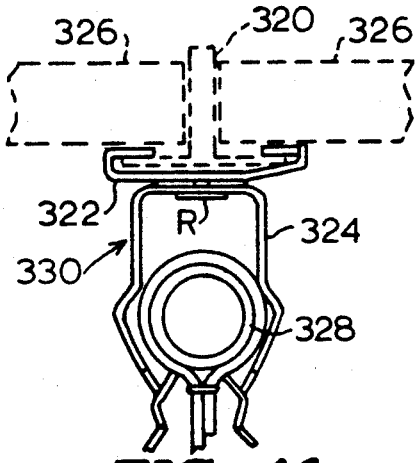
FIG. 16 is an end elevation view of an alternate clip of the invention having an upper rider slidingly mounted onto a "T" bar support for a suspended panel ceiling and a jaw holding a curtain supporting bar.

As relating to a hung panel ceiling, shown in FIG. 16, panels 326 are supported below the structural roofing members on a gridwork of "T" bars 320. An adaptive combination being "T" bar clip 330, made of B-Line Systems, Inc. Items #BA-4-16 (jaw 324) and BP-8-4T (slide clip 322) is used to mount the curtain system of the invention according to methods described earlier. Slide clip 322 is assembled to jaw 324 by means of rivet R to enable relative rotation. By this method, conduit 328 can be oriented either parallel to or perpendicular to the long dimension of "T" bar 320.

Similarly, other adaptive variations of the embodiment of the invention would apply to further roof or ceiling possibilities. In addition, a building configuration which is narrow and would have its ceiling area divided by curtains in only the widthwise direction or a round building wherein the cells created would not be of uniform shape would be benefitted by the principles of the invention.

Therefore, the specific preferred embodiment disclosed herein is to be construed as exemplary and not to be considered a limitation upon the scope and principles of this invention.

What is claimed is:

1. A smoke containment curtain system for dividing space beneath a building roofing deck supported by a plurality of structural members into smoke confining cells so as to enable exhaustion of smoke from said cells, comprising:

(a) vertically hung smoke impervious space separating means located so as to form smoke confining cells in such space; and (b) resilient clamping means having inwardly facing retaining barbs and being adapted to attach to roofing deck supporting structural members for suspending said vertical separating means therebelow.

2. A smoke containment curtain system as claimed in claim 1, further comprising means for forming smoke impervious seals between said vertical separating means and said roofing deck.

3. A smoke containment curtain system for dividing space beneath a building roofing deck supported by a plurality of structural members into smoke confining cells so as to enable exhaustion of smoke from said cells, comprising:

(a) a vertically hung smoke impervious rectangular curtain formed with upper and lower continuous pockets extending widthwise of said curtain;

(b) an upper bar member inserted in said upper pocket and adapted for being fixedly attached to a structural member supporting the roofing deck of a building;

(c) a lower bar member inserted in said lower pocket and supported by said curtain;

(d) a plurality of vertical cross bar members each being fixedly secured to and extending between said upper and lower bar members; and (e) clamping means fixedly attaching said upper bar member to said structural member and operative to vertically hang said curtain in a location contributing to the formation of at least two such cells.

4. A smoke containment curtain system as claimed in claim 3 wherein said clamping means comprises a plurality of resilient jaw clips.

5. A smoke containment curtain system as claimed in claim 4 wherein each of said resilient jaw clips comprises a double jawed barbed clip having a pair of jaws facing in opposite directions and offset from one another.

6. A smoke containment curtain system as claimed in claim 3 wherein said curtain is made of a resin coated fiber glass fabric.

7. A smoke containment curtain system as claimed in claim 3 wherein said upper, lower and cross bar members comprise tubular, metallic members.

8. A smoke containment curtain system as claimed in claim 3 wherein said structural members comprise wood structural members and said clamping means comprises a clip having a nailing hole at one end and a resilient jaw at the other end.

9. A smoke containment curtain system as claimed in claim 7 further comprising "T" connectors and five-way connectors connecting said upper, lower and cross bar members.

10. A smoke containment curtain system as claimed in claim 6 further comprising a pressure sensitive adhesive coated smoke impervious tape assembled so as to seal joints and cuts in said curtain and seal said curtain to said roofing deck.

11. A method of establishing a smoke containment curtain system for dividing space beneath a building roofing deck supported by a plurality of structural members into smoke confining cells so as to enable exhaustion of smoke from said cells, comprising:

(a) supplying a smoke impervious fabric having two substantially parallel longitudinal edges;
(b) sewing a pocket along each longitudinal edge of said fabric to form first and second pockets;
(c) inserting a first bar member into the first of said pockets to form a fabric and bar member assembly;
(d) attaching one jaw of a double jaw resilient clip to said bar member said fabric and bar member assembly;
(e) attaching a second jaw of said double jaw resilient clip to a roofing deck supporting structural member; and
(f) inserting a second bar member into the second of said pockets whereby to establish said curtain in a vertically hung position operative to contribute to the formation of at least two said cells.

12. A method of establishing a smoke containment curtain system as in claim 11 further comprising connecting adjacent lengths of said first and second bar members by means of "T" connectors.

13. A method of installing a smoke containment curtain system as claimed in claim 12 further comprising inserting a cross bar member between said first and second bar members and engaged by said "T" connectors located on said first and second bar members.

14. A method of installing a smoke containment curtain system as claimed in claim 13 further comprising connecting said first and second bar members of said curtain to respective first and second bar members of an intersecting curtain by means of a five-way connector.

15. A method of installing a smoke containment curtain system as claimed in claim 14 further comprising sealing a joint or a cut in said fabric by means of a pressure sensitive adhesive coated smoke impervious tape.

16. A smoke containment curtain system for dividing the space beneath a hung panel ceiling supported by a plurality of intersecting "T" frame members, comprising:

(a) a smoke impervious rectangular curtain formed with upper and lower continuous pockets extending widthwise of said curtain;
(b) an upper bar member inserted in said upper pocket and fixedly attached to a ceiling supporting "T" bar member;
(c) a lower bar member inserted in said lower pocket and supported by said curtain;
(d) a plurality of vertical cross bar members each being fixedly secured to and extending between said upper and lower bar members; and
(e) clip means having a "T" bar clip at one end thereof and having a resilient jaw at the other end.

* * * * *

UNITED STATES PATENT AND TRADEMARK OFFICE

CERTIFICATE OF CORRECTION

PATENT NO. : 5,240,058

DATED : August 31, 1993

INVENTOR(S) : Thomas T. Ward

It is certified that error appears in the above-identified patent and that said Letters Patent is hereby corrected as shown below:

Column 9, line 31, "and" should read --of said--

Signed and Sealed this

Twenty-second Day of March, 1994

Bruce Lehman

*Attest:*

BRUCE LEHMAN

*Attesting Officer*

*Commissioner of Patents and Trademarks*